US006068605A

United States Patent [19]

Bjørnsti

[11] Patent Number: 6,068,605

[45] Date of Patent: May 30, 2000

[54] MASSAGE APPARATUS

[76] Inventor: Yngve Bjørnsti, Sjåmo, 8650 Mosjöen, Norway

[21] Appl. No.: 09/057,472

[22] Filed: Apr. 9, 1998

[30] Foreign Application Priority Data

Apr. 9, 1997 [NO] Norway ..... 971616

[51] Int. Cl.[7] ..... A61H 15/00

[52] U.S. Cl. ..... 601/119; 601/122; 601/123; 601/127

[58] Field of Search ..... 601/119, 122, 601/123, 127, 134

[56] References Cited

U.S. PATENT DOCUMENTS

| | | | |
|---|---|---|---|
| 2,230,890 | 2/1941 | McClenathen . | |
| 2,285,958 | 6/1942 | Wheelock | 601/122 |
| 2,461,102 | 2/1949 | Ackerman | 601/99 |
| 4,173,972 | 11/1979 | Kodera | 128/52 |
| 5,643,182 | 7/1997 | Engel . | |

FOREIGN PATENT DOCUMENTS

| | | | |
|---|---|---|---|
| 0 123 968 | 11/1984 | European Pat. Off. . | |
| 35 37 081 | 4/1987 | Germany . | |
| 213756 | 6/1941 | Switzerland | 128/57 |

*Primary Examiner*—Richard J. Apley
*Assistant Examiner*—Tam Nguyen
*Attorney, Agent, or Firm*—Wenderoth, Lind & Ponack, L.L.P.

[57] ABSTRACT

An apparatus is provided for massaging parts of the body, preferably feet and legs. This apparatus is of the type where at least two rollers (1, 12) press against and are moved along the respective part of the body. The apparatus comprises a lower wheel wagon (16), a frame (15) attached to the wheel wagon (16), a lower rotatable roller (12) connected to the frame (15), a first arm (5) with a first end connected to the frame (15), a second arm (4) with a first end linked by a joint to the first arm's (5) second end, an upper rotatable roller (1) connected to the second arm's (4) second end, and a handle (2) connected to the second arm (4).

15 Claims, 4 Drawing Sheets

MASSAGE APPARATUS

BACKGROUND OF THE INVENTION

The present invention relates to an apparatus for the massaging of body parts, preferably the feet and legs. In particular, the invention relates to an apparatus of the type where at least two rollers press against and are moved along the respective part of the body.

Poor blood circulation, particularly in the legs, has to an increasing degree become a problem for many people. Poor blood circulation causes pain and often numb cold feet. The present invention can be useful in stimulating body parts to help circulation problems such as these.

There exist today a number of apparatus for blood circulation stimulation. The disadvantages with these apparatus are that they require too much space; they are difficult for the patient to operate; and the effect or benefit from using these machines is often not satisfactory.

One object of the present invention is therefore to provide a simple apparatus that is easy to operate and that treats the patient in an effective way.

Another object of the present invention is to stimulate blood vessels and, particularly, the smaller veins to improve blood circulation over time.

A further object is to improve the quality of life of the patient, and in more serious cases to prevent amputation of legs due to reduced blood circulation.

Yet another object of the apparatus is to massage and loosen muscles, for example, stiff calf muscles.

SUMMARY OF THE INVENTION

These objects are achieved according to the present invention by an apparatus for massaging parts of the body, preferably feet and legs. The apparatus is of the type where at least two rollers are pressed against and moved along a respective part of the body. The apparatus comprises a lower wheel wagon and a frame attached to the wheel wagon. A lower rotatable roller is arranged within and fastened to the frame. A first arm is provided with a first end attached to the frame, and a second arm is provided with a first end linked through a joint to the first arm's second end. An upper rotatable roller is attached to the second arm's second end, and a handle is also attached to the second arm.

The lower rotatable roller consists of a number of mutually spaced longitudinally extending (in relation to the longitudinal axis about which the lower roller rotates) straps. A circumferentially extending strap is provided, which is located in the centre area of the roller. The longitudinally extending strap provides for a substantial portion of the surface area for massaging the body parts. The circumferentially extending strap will slide on the longitudinally extending straps in order to obtain approximately the same speed of rotation at the centre of the roller as at the larger diameter side edges of the roller.

Preferred designs of the apparatus in accordance with the invention are described more fully in the detailed description.

BRIEF DESCRIPTION OF THE DRAWINGS

A design of the present invention will now be explained with reference to the enclosed drawings, where.

DETAILED DESCRIPTION OF THE INVENTION

Figure 3:
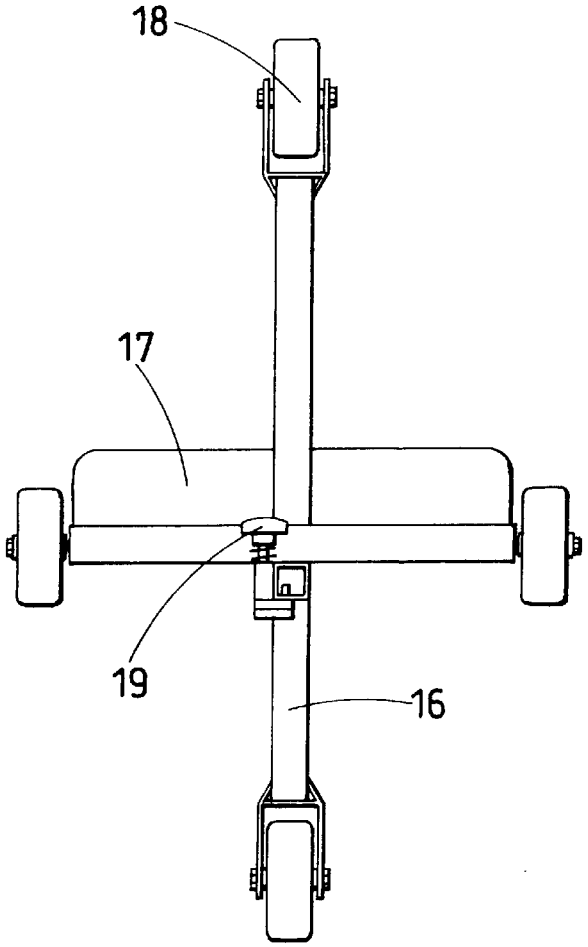
FIG. 3 shows a plan view of the apparatus.
Figure 1:
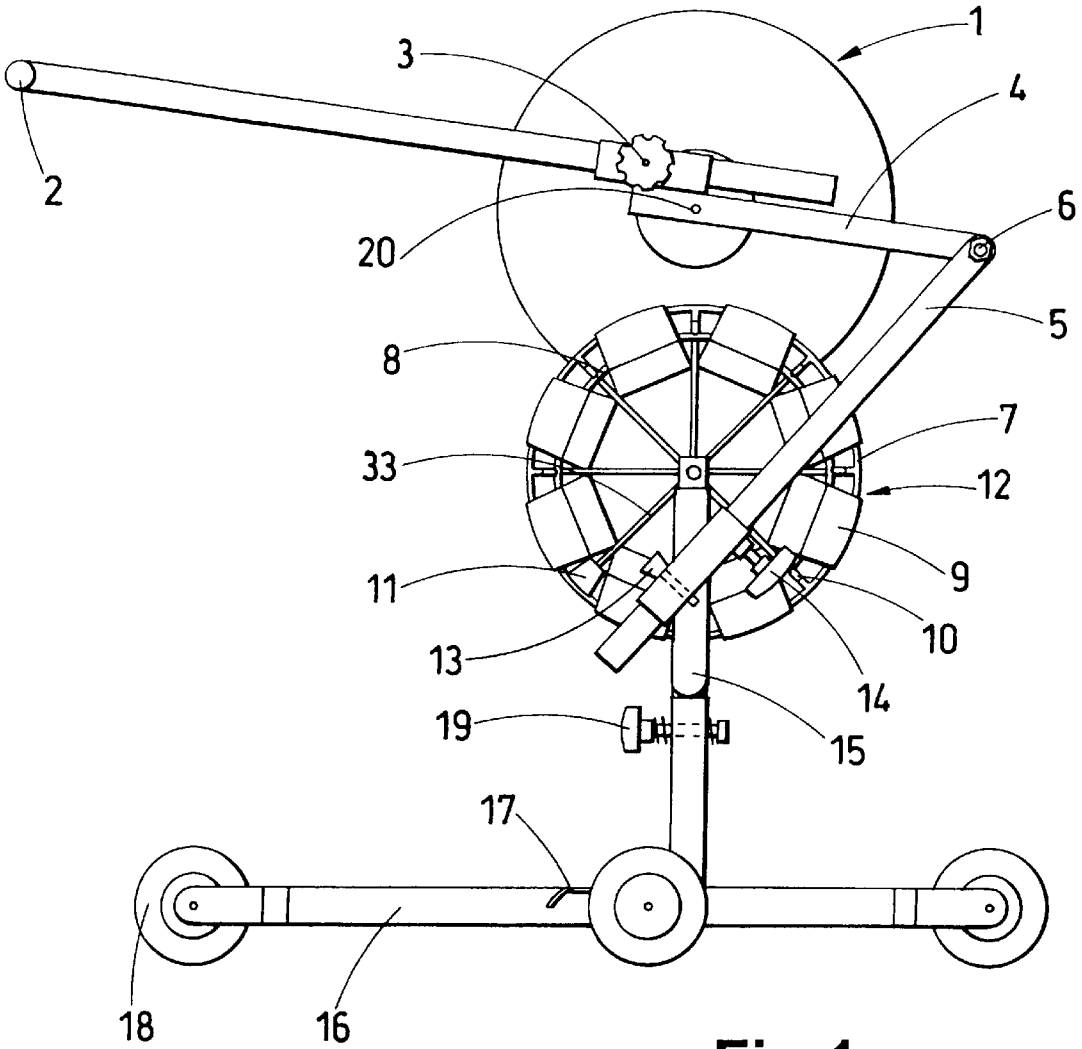
FIG. 1 shows a side view of the apparatus.
Figure 4:
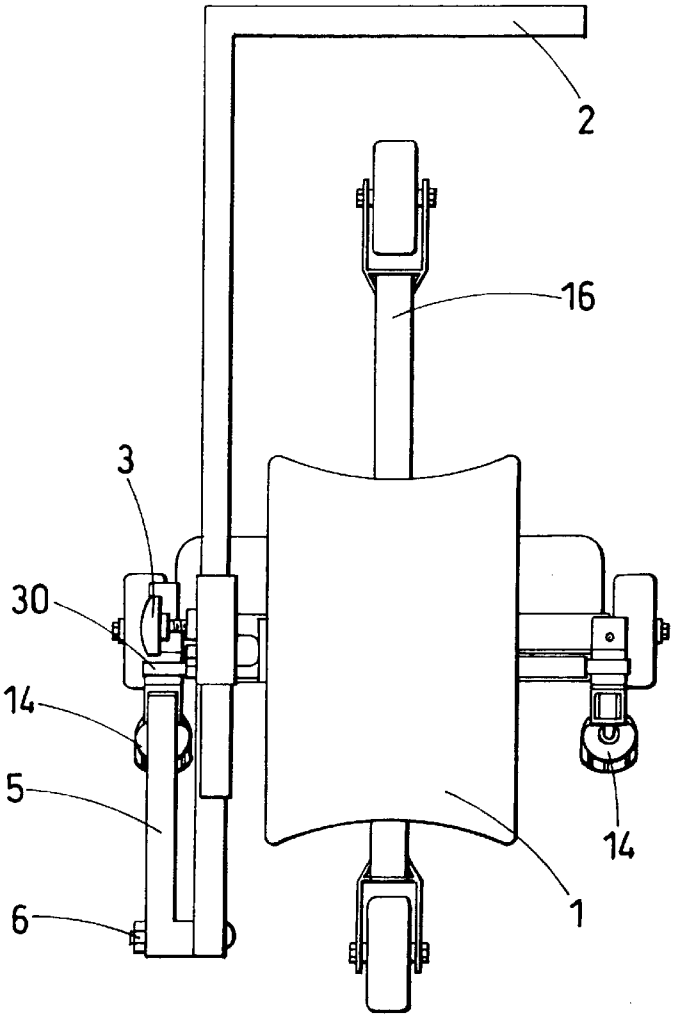
FIG. 4 shows a rear view of the apparatus.
Figure 5:
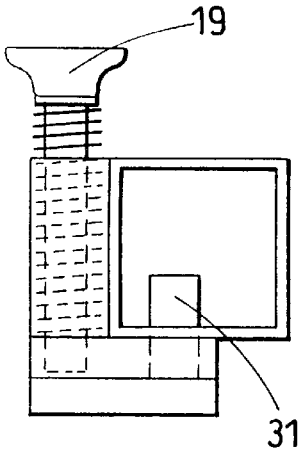
FIG. 5 shows a detailed view of a locking bolt.

With reference to the above-mentioned Figures, the apparatus consists of a wheel wagon (under carriage) 16 with four wheels 18 as shown in FIG. 3. The massaging portion itself, including frame 15, as shown in FIG. 1, is connected to the wheel wagon 16 in a telescopic way. The height can be adjusted by operating a locking button 19. The frame 15 with holes for locking bolt 31, as shown in FIG. 5, can be lowered and raised telescopically in relation to the wheel wagon 16.

The patient can operate the apparatus while sitting on a chair. The patient's hands can grip around the handle 2 and lift an upper roller 1, preferably made of a soft material (foam). The handle will thus pivot around the bearing 6 as shown in FIG. 1. The patient then puts his leg on the lower roller 12. Roller 12 is preferably constructed of cloth straps 9 fastened to outer (in relation to the longitudinal axis of the roller) ring 8 and placed over inner ring 7. The outer foot is placed on a foot board 17 enabling one to push and pull the apparatus with the arms and the foot. The leg being massaged will rest in a relatively horizontal position during a massage between the knee and the ankle. The pressure on the leg from roller 1 can easily be varied by increasing the pressure on the handle 2, which will provide pressure from upper roller 1 to the leg. In turn, pressure from the lower roller 12 to the leg is also increased.

During treatment the foot may be twisted in order to achieve the best possible massaging effect.

The lower rotatable roller 12 is constructed such that the circumferentially extending strap 32 will slide on the longitudinally extending straps 9 during operation. The result is that the speed of rotation at the center of roller 12 will be approximately the same as in the larger diameter side edges of the roller 12. Hence, an improved massaging (milking) effect of the leg will be achieved. Due to the above described construction of the lower roller 12, and also due to the resilience of the material used for the roller 12, the pressure in the contact area will assume an even distribution around the leg. This feature further increases the effect of the treatment and also increases the comfort of the patient.

A pair of adjustment screws 14 are provided which adjustably hold arm 5 within a sleeve portion of frame 15 (see FIG. 1). As screws 14 are loosened, arm 5 can be moved within frame 15 to a desired position. Therefore, the apparatus is constructed so that it can be adjusted and thus be used for treating patients of various size. For example, the operator of the apparatus may massage the patient's thigh muscles by adjusting the pressure adjusting screws 14. In addition, by pulling out the locking bolt 13, a first arm 5 may be raised. To adapt the apparatus to enable legs of various thickness to fit between the rollers, first arm 5 can be pulled out and moved over to the other side of the roller 12. Consequently, both the right and left thigh can be treated. If the patient is lying on a bench, the height of the massage apparatus can be adjusted by pressing a locking button 19 to raise frame 15.

With reference to FIGS. 6–9, the lower roller 12 consists of a square central pipe 26 and two outer pipe portions 27, with axial fingers 30 welded on and extending in an axial direction from each end of the central pipe 26. The two outer pipe portions 27 are arranged so they can slide in relation to the central pipe 26. Two spoke wheels 37 are provided which each includes several spokes 33, an inner ring 7, and an outer ring 8. The spokes 33 of each of the two spoke wheels 37 are welded to each of the two outer pipe portions 27 and extend outwardly therefrom. The spokes 33 of the spoke wheels 37 are in turn welded onto inner ring 7. The spokes 33 of each of two spoke wheels 37 have fastening hooks 10 welded thereon. Each of the fastening hooks 10 includes a locking ring 11 to hold outer ring 8 in place.

Figure 2:
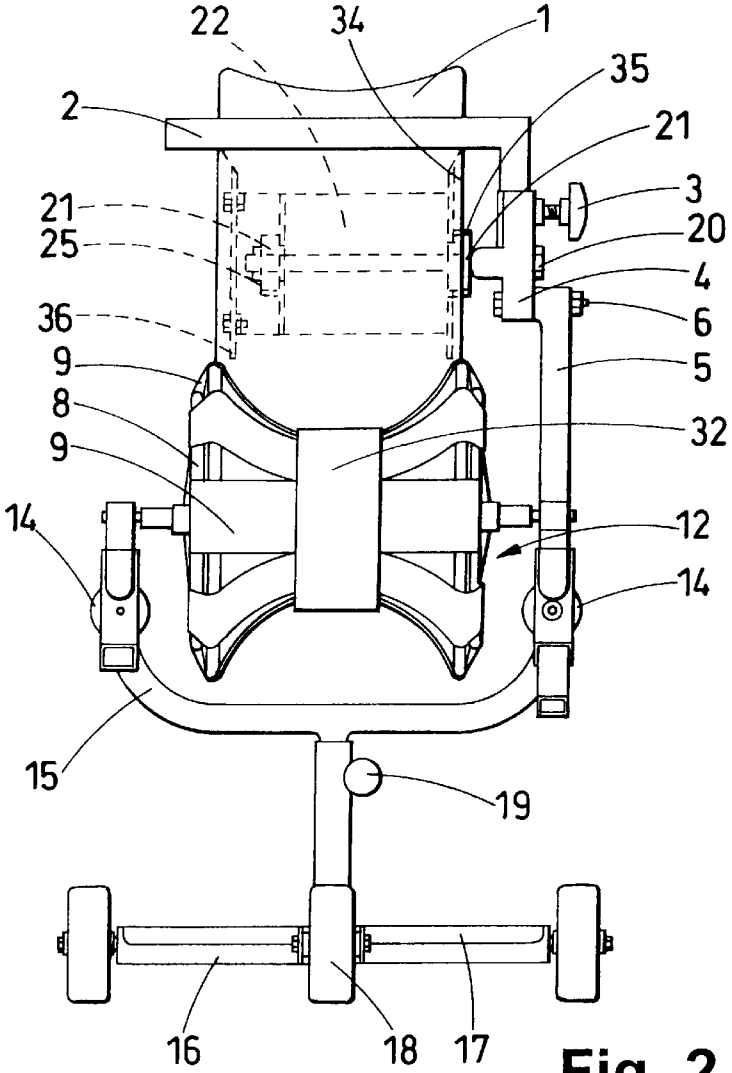
FIG. 2 shows a front view of the apparatus.
Figure 6:
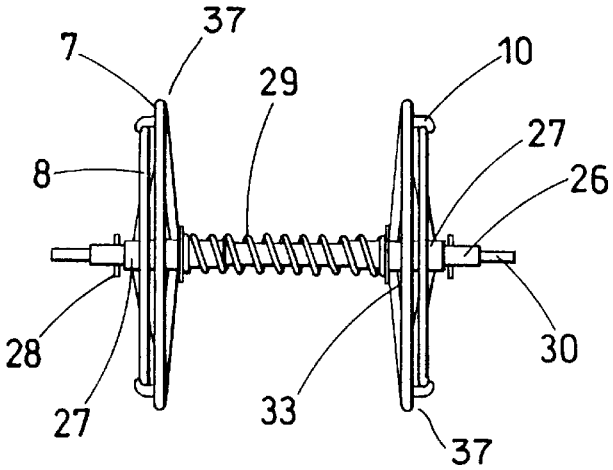
FIG. 6 shows a detail of the inner construction of the lower roller arranged on an axle.
Figure 7:
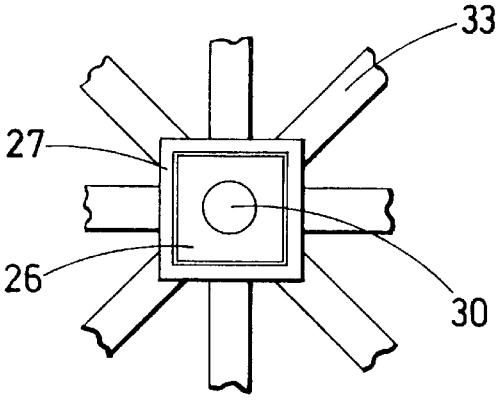
FIG. 7 shows a detail of the lower roller's spoke fastened to the above mentioned axle.
Figure 8:
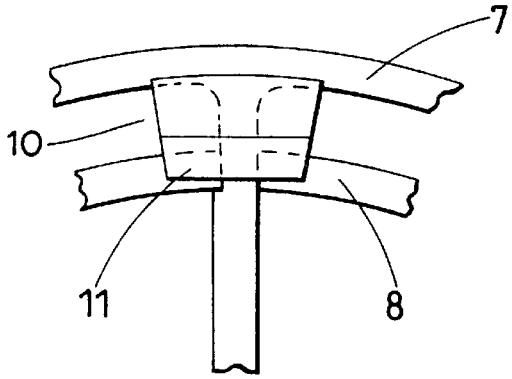
FIG. 8 shows a detail of the spokes' fastening to the lower roller's outer and inner ring.
Figure 9:
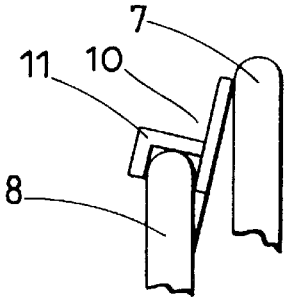
FIG. 9 shows a detail of the locking arrangement for the outer and the inner ring in FIG. 8.

A spring 29, as shown in FIG. 6, is fitted on the outside of central pipe 26, between the two spoke wheels 37, to force the spoke wheels outward. Locking bolt 28 can be inserted into desired holes in the central pipe 26 or through both pipes 26 and 27 to adjust the distance between the spoke wheels 37. Consequently, the size and pressure applied by the lower roller 12 can be varied according to the thickness of a patient's leg. Straps of material (ribbons) 9 are pulled onto the outer ring 8 of one spoke wheel 37 as shown in FIG. 2. The same set-up is made for the other spoke wheel 37 on the other side. The circumferential strap 32 is then put around the straps 9 to keep them in place.

In an alternate embodiment, the lower roller 12 has a central pipe 26 with axial fingers 30 extending therefrom. Two plate-like wheels 37 are arranged spaced apart on and fixed to the central pipe 26. Longitudinally extending straps 9 are provided which are wrapped around the outer circumference of each of the fixed wheels 37. A circumferentially extending strap 32 is wrapped around straps 9.

As shown in FIG. 2, the lower roller 12 is supported by frame 15. The axial fingers 30 extending from the central pipe 26 of the lower roller 12 are connected to frame 15 so as to allow the lower roller to rotate.

The handle 2 can be adjusted lengthways by adjusting a screw 3 of a locking device mounted on a second arm 4. The upper roller (cylinder) 1 consists of a soft material (such as foam) which is fastened to pipe 22. The pipe 22 has an end plate 34 welded thereon. A bearing seat 35 for ball bearing 21 is fastened to the end plate 34. Plates 34 and 36 keep the foam roller in place. Ball bearing 21 is fitted to bolt 20. Bolt 20 and nut 25 connect the upper roller 1 to the second arm 4.

Figure 10:
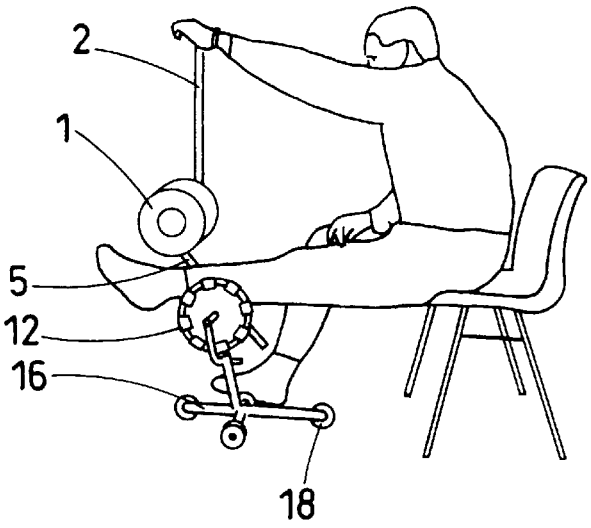
FIG. 10 shows the apparatus in an initial position for treatment of a patient.
Figure 11:
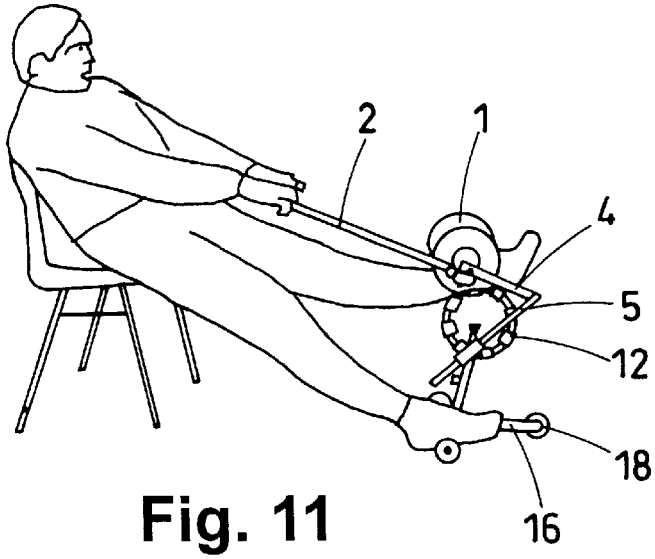
FIG. 11 shows a starting position for treating patients.
Figure 12:
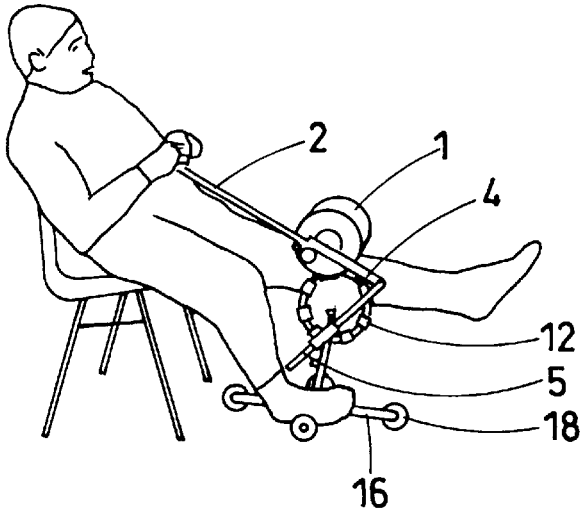
FIG. 12 shows the apparatus' function during treatment.

As shown in FIGS. 10–12, a patient's leg is placed on the lower roller 12. The patient grasps and pulls the handle, lowering the upper roller 1. The apparatus is moved backwards and forwards while the patient sits in a chair with a leg extended straight on the lower roller 12. When the patient pushes the apparatus away, no pressure is applied. However, when the apparatus is pulled back toward the patient, the handle is pulled down in a way that the foam roller pumps blood to the heart, and muscles are loosened.

The present invention is described above with the help of an example, but it will be apparent to a person skilled in the art that the apparatus according to the invention can be modified and developed within the scope of the claims.

What is claimed is:

1. An apparatus for massaging body parts, comprising:

a wheel wagon;

a frame connected to said wheel wagon;

a lower roller rotatably connected to said frame, said lower roller including a plurality of longitudinally extending straps evenly spaced around a periphery of said lower roller, said lower roller further including a circumferentially extending strap provided around said plurality of longitudinally extending straps such that said circumferentially extending strap is capable of sliding in relation to said plurality of longitudinally extending straps;

a first arm having a first end and a second end, said first end being connected to said frame;

a second arm having a first end and a second end, said first end being pivotally connected to said second end of said first arm;

an upper roller rotatably connected to said second end of said second arm; and a handle connected to said second arm.

2. The apparatus of claim 1, wherein said upper roller is constructed of a soft material.

3. The apparatus of claim 2, wherein said soft material is foam.

4. The apparatus of claim 1, wherein each of said longitudinally extending straps and said circumferentially extending strap are constructed of a resilient material.

5. The apparatus of claim 1, wherein said lower roller has an adjustable length.

6. The apparatus of claim 1, wherein said lower roller further includes:

a central pipe having a first end and a second end, and an axial finger extending in a longitudinal direction from each of said first end and second end;

a first spoke wheel and a second spoke wheel provided on said central pipe, each of said spoke wheels having an inner ring and an outer ring, said outer ring having a smaller diameter than said inner ring, said first spoke wheel and said second spoke wheel being spaced apart from each other and capable of sliding along said central pipe, each of said longitudinally extending straps extending from said outer ring of said first spoke wheel over said inner ring of said first spoke wheel to said outer ring of said second spoke wheel over said inner ring of said second spoke wheel;

a spring provided on said central pipe between said first spoke wheel and said second spoke wheel; and a first moveable lock bolt and a second moveable lock bolt, said lock bolts being provided on said central pipe on an outer side of each of said spoke wheels such that said first spoke wheel is located between said spring and said first lock bolt and said second spoke wheel is located between said spring and said second lock bolt.

7. The apparatus of claim 6, wherein said upper roller is constructed of a soft material.

8. The apparatus of claim 7, wherein said soft material is foam.

9. The apparatus of claim 6, wherein each of said longitudinally extending straps and said circumferentially extending strap are constructed of a resilient material.

10. The apparatus of claim 1, wherein said lower roller further includes:

a central pipe having a first end and a second end, and an axial finger extending in a longitudinal direction from each of said first end and second end;

a first wheel and a second wheel fixed to said central pipe, said first wheel and said second wheel being spaced apart from each other, each of said plurality of longitudinally extending straps extending from said first wheel to said second wheel.

11. The apparatus of claim 10, wherein said upper roller is constructed of a soft material.

12. The apparatus of claim 11, wherein said soft material is foam.

13. The apparatus of claim 10, wherein each of said wheels have a plate-like configuration.

14. The apparatus of claim 10, wherein each of said plurality of longitudinally extending straps extends over an outer circumference of each of said wheels.

15. The apparatus of claim 10, wherein each of said longitudinally extending straps and said circumferentially extending strap are constructed of a resilient material.

* * * * *